United States Patent [19]

Eggert et al.

[11] 4,258,229

[45] Mar. 24, 1981

[54] BODY VIBRATION PICKUP

[75] Inventors: Albert Eggert; Wolfgang Schmidt, both of Berlin, Fed. Rep. of Germany

[73] Assignee: Robert Bosch GmbH, Stuttgart, Fed. Rep. of Germany

[21] Appl. No.: 86,580

[22] Filed: Oct. 19, 1979

[30] Foreign Application Priority Data

Oct. 24, 1978 [DE] Fed. Rep. of Germany ... 7831611[U]

[51] Int. Cl.[3] ..... H04R 1/46

[52] U.S. Cl. ..... 179/1 ST; 179/121 C

[58] Field of Search ..... 179/1 ST, 157, 110 A, 179/121 C; 310/330, 331, 332, 345

[56] References Cited

U.S. PATENT DOCUMENTS 3,573,394 4/1971 Birnbaum ..... 310/331

*Primary Examiner*—George G. Stellar

*Attorney, Agent, or Firm*—Spencer & Kaye

[57] ABSTRACT

In a body vibration pickup including a housing, a piezoelectric element disposed in the housing and a vibration conductor mounted to conduct sound vibrations of a body to the piezoelectric element, a diaphragm is disposed in the housing between the piezoelectric element and the vibration conductor in an electrically conductive manner, and a resilient cast mass is disposed in the housing and the diaphragm, the piezoelectric element and the part of the vibration conductor which extends into the housing are embedded therein.

15 Claims, 1 Drawing Figure

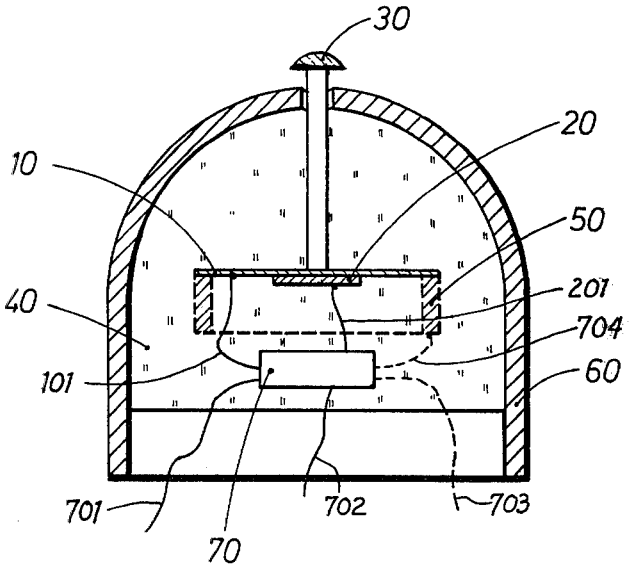
30
20
10
50
201
40
704
101
60
701
702
703
70

BODY VIBRATION PICKUP

BACKGROUND OF THE INVENTION

The present invention is based on a body vibration pickup, particularly for an electronic stethoscope, which pickup is of the type including a housing, piezoelectric element in the housing, and a vibration conductor arranged to convey vibrations of a body being attached to the piezoelectric element. In a known body vibration pickup, disclosed in German Utility Model Patent No. 77 19 777, a vibration conductor transmits the sound vibrations of a body to a piezoelectric element, and a special mount connected with the housing of the body vibration pickup is provided for the piezoelectric element and the vibration conductor. This mount is composed of two rigid metal bodies which are firmly connected together by means of a disc of insulating material and between which the piezoelectric element is disposed. The upper side of the piezoelectric element is connected to the metallic vibration conductor which passes through an opening of the upper metal body, while the underside of the piezoelectric element rests on the lower metal body in a plane parallel orientation. The lower metal body has a mass which is large compared to the piezoelectric element.

Although such prior art body vibration pickup has been found to be satisfactory, its relatively great weight has an annoying effect and it is complicated to manufacture, which does not always result in economical production.

SUMMARY OF THE INVENTION

It is an object of the present invention to provide an improved body vibration pickup which is free of the above-noted drawbacks.

This and other objects are achieved according to the present invention by disposing a diaphragm in an electrically conductive manner between the vibration conductor and the piezoelectric element and encapsulating the vibration conductor, piezoelectric element and diaphragm in a resilient cast mass in the vibration pickup housing.

The body vibration pickup according to the invention has the advantage that it presents a considerably increased sensitivity compared to prior art structures so that only slight amplification is required to obtain perfect measuring results. Due to the low gain required, there also no longer occurs the annoying and disadvantageous noise development which usually accompanies high amplification. Moreover, the body vibration pickup according to the invention is distinguished by low weight so that it is convenient to handle. Furthermore, due to its simple configuration, the body vibration pickup according to the invention can be produced cost-effectively so that economic manufacture is possible.

As a result of further features of the invention, to be described in detail below, advantageous modifications and and improvements can be realized for the basic body vibration pickup according to the invention. It is here of particular advantage to apply a metal ring at the circumferential edge of the diaphragm so as to favorably influence its frequency response.

BRIEF DESCRIPTION OF THE DRAWING

The sole FIGURE is a cross-sectional elevational view of a preferred embodiment of the body vibration pickup according to the invention.

DESCRIPTION OF THE PREFERRED EMBODIMENTS

The sole FIGURE is a sectional view of an embodiment of a body vibration pickup, or microphone, for a stethoscope, which essentially includes a diaphragm 10, preferably of bronze, a piezoelectric plate 20 and a vibration conductor 30, the piezoelectric plate 20 advantageously being glued or otherwise bonded to the diaphragm 10. The vibration conductor 30 conducts the body sounds from a subject being examined onto the piezoelectric plate. The diaphragm 10 here acts as an abutment for vibration conductor 30.

Preferably, the entire microphone arrangement, including the diaphragm 10, the piezoelectric plate 20 and the vibration conductor 30, is embedded in housing 60 in a mass 40 of a rubber-like cast material. The rubber-like material 40 serves mainly to attenuate sounds carried through the air.

A metal ring 50 shown in broken lines, may advantageously be attached to the circumferential face of the diaphragm 10 so as to favorably influence the frequency response of the resulting stethoscope microphone. The metal ring 50 can then also be used very well to establish a mass contact. Due to the metal ring 50 being disposed at the circumferential edge of diaphragm 10, the effectiveness of the diaphragm as an abutment can be increased in addition.

Due to the embedding of the microphone arrangement including the diaphragm 10, the piezoelectric plate 20 and the vibration conductor 30, in a rubber-like mass, effective attenuation can be achieved with respect to air-borne vibrations, which in the prior art strongly decreased the sensitivity of such instruments. Due to the rubber-like material employed, the movement of the vibration conductor 30 is not restricted thereby so that sensitive operation of the body vibration pickup is assured. The rubber-like material serving as the encasing mass may preferably be based on silicone. The diaphragm 10 and the piezoelectric element 20 are preferably designed as plate-shaped discs, the diaphragm advantageously having a larger diameter than the piezoelectric element. The diaphragm and the piezoelectric element as well as the vibration conductor, are arranged essentially concentrically to one another.

Due to the simple design of body vibration pickups according to the invention, cost-effective manufacture is possible which permits economical production of the stethoscope microphone. Thus a reliable and sensitive stethoscope microphone is provided which is additionally distinguished by relatively low weight and high sensitivity to the body sounds to be picked up. Due to its high sensitivity to body sounds, only low amplification is required so that the development of noise generally encountered when high amplification is employed does not occur.

According to a further advantageous embodiment of the body vibration pickup, a preamplifier 70, built for example as an integrated element, is also encased in the casing mass 40 preferably directly behind the piezoelectric element 20, and has inputs connected across element 20.

Moreover, the cap, or button, of the vibration conductor 30 which contacts the subject, preferably is made of plastic with either a smoothly polished or very rough surface.

A smoothly polished surface of the cap is desirable because each displacement of the vibration pickup during a measurement causes less rubbing noises than a rough surface. A rough surface of the cap otherwise has the advantage of preventing unwanted displacements during applying the vibration pickup.

As well as the metal ring 50 is provided or not provided the diaphragm, the element 20 and the inner part of the vibration conductor are completely embedded in the resilient cast mass 40. This mass is preferably a sealing compound, type 56 (Wacker Chemie, Western Germany) which has a Shore hardness of about 30 is polymerized.

In spite of the relative low elasticity of mass 40, which will attenuate air-borne vibrations, the sensivity of the microphone arrangement is so high, that under normal conditions a preamplifier has not to be applied.

In a microphone arrangement tried out the diaphragm 10 has a diameter of 24 mm and a thickness of 0.4 mm. The piezoelectric plate 20 has a diameter of 10 mm and a thickness of 0.2 mm.

If no preamplifier 70 is provided only two conductors 101, 201 are necessary. The conductor 101 serves for ground connection and conductor 102 for signal connection. In case that a preamplifier is provided the two input terminals of this amplifier are connected with connectors 101, 201. The two output terminals of the preamplifier are connected with other conductors 701, 702. A conductor 703 of two further conductors 703, 704 which are shown in broken lines, can be connected with a potential of a power source which supplies the preamplifier. Conductor 704 can be provided in the preamplifier has an additional ground connector which may be connected with metal ring 50. It will be understood that the above description of the present invention is susceptible to various modifications, changes and adaptations, and the same are intended to be comprehended within the meaning and range of equivalents of the appended claims.

What is claimed is:

1. In a body vibration pickup including a housing, a piezoelectric element disposed in the housing and a vibration conductor mounted to conduct sound vibrations of a body to the piezoelectric element, the improvement comprising a diaphragm disposed in said housing between said piezoelectric element and said vibration conductor in an electrically conductive manner, and a resilient cast mass disposed in said housing and in which said diaphragm, said piezoelectric element and the part of said vibration conductor which extends into said housing are embedded.

2. Body vibration pickup as defined in claim 1 for use in an electronic stethoscope.

3. Body vibration pickup as defined in claim 1 wherein said diaphragm is made of a bronze material.

4. Body vibration pickup as defined in claim 1 or 3 wherein said piezoelectric element is glued onto said diaphragm.

5. Body vibration pickup as defined in claim 1 or 3 wherein said diaphragm and said piezoelectric element are plate-shaped discs.

6. Body vibration pickup as defined in claim 5 wherein the diameter of said diaphragm is greater than that of said piezoelectric element.

7. Body vibration pickup as defined in claim 5 wherein said vibration conductor, said diaphragm and said piezoelectric element are arranged essentially concentrically to one another.

8. Body vibration pickup as defined in claim 1 further comprising a conductive member mounted at the circumferential edge of said diaphragm.

9. Body vibration pickup as defined in claim 8 wherein said member comprises a metal ring.

10. Body vibration pickup as defined in claim 1 wherein said cast mass is constituted by a rubber-like material.

11. Body vibration pickup as defined in claim 10 wherein said cast mass is a silicone based material.

12. Body vibration pickup as defined in claim 1 further comprising a preamplifier encased in said cast mass behind said piezoelectric element and electrically connected thereto.

13. Body vibration pickup as defined in claim 1 wherein said vibration conductor includes a cap for contacting the body, said cap being made of plastic.

14. Body vibration pickup as defined in claim 13 wherein said cap has a smoothly polished surface.

15. Body vibration pickup as defined in claim 13 wherein said cap has a very rough surface.

* * * * *